US005623876A

United States Patent [19]

Murphy, III et al.

[11] Patent Number: 5,623,876

[45] Date of Patent: Apr. 29, 1997

[54] APPARATUS AND METHOD FOR POSITIONING A PRINTING MECHANISM BETWEEN STATIONS IN A MAIL HANDLING APPARATUS

[75] Inventors: Charles F. Murphy, III, Milford; Patrick Murphy, Stamford, both of Conn.

[73] Assignee: Pitney Bowes Inc., Stamford, Conn.

[21] Appl. No.: 518,612

[22] Filed: Aug. 23, 1995

[51] Int. Cl.[6] ..... B41J 2/165

[52] U.S. Cl. ..... 101/483; 101/425; 400/702; 347/33

[58] Field of Search ..... 400/320, 320.1, 400/328, 29, 30, 31, 143, 142, 140, 701–702; 101/45, 483, 425; 347/33

[56] References Cited

U.S. PATENT DOCUMENTS

| | | | |
|---|---|---|---|
| 3,605,978 | 9/1971 | Kawano | 400/320 |
| 4,401,990 | 8/1983 | Aiba et al. | 347/33 |
| 4,436,439 | 3/1984 | Koto | 400/328 |
| 4,538,160 | 8/1985 | Uchiyama | 400/328 |
| 4,576,495 | 3/1986 | Fulbright et al. | 400/328 |
| 4,787,761 | 11/1988 | Tezuka et al. | 400/328 |
| 5,459,503 | 10/1995 | Ishii | 400/320 |
| 5,481,283 | 1/1996 | Watanabe et al. | 347/33 |

FOREIGN PATENT DOCUMENTS

| | | | |
|---|---|---|---|
| 405193151A | 8/1993 | Japan | 347/33 |

*Primary Examiner*—Eugene H. Eickholt

*Attorney, Agent, or Firm*—Steven J. Shapiro; Melvin J. Scolnick

[57] ABSTRACT

A mail handling apparatus having a printing mechanism; a device for moving the printing mechanism along a path of travel between a printing mechanism printing position and a printing mechanism maintenance position; a maintenance station positioned lateral to the path of travel; and a device for rotating the printing mechanism along the path of travel to align the printing mechanism for engagement with the maintenance station as the printing mechanism moves into the maintenance position.

9 Claims, 4 Drawing Sheets

APPARATUS AND METHOD FOR POSITIONING A PRINTING MECHANISM BETWEEN STATIONS IN A MAIL HANDLING APPARATUS

BACKGROUND

This invention relates to an apparatus and method for positioning a printing mechanism, and more particularly to a printing mechanism for positioning a printing mechanism between printing and maintenance stations in a mail handling apparatus.

Mail handling machines, such as that described in U.S. Pat. No. 4,935,078 process mixed mailpieces (varying size) in a high speed manner. These known mail handling machines typically include a front end feeder, a singulator, a moistener, a sealer, and a printing device. The front end feeder shingles the incoming mailpieces (such as envelopes) and the singulator grabs the bottom envelope from the shingled stack of envelopes for subsequent processing downstream. Upon passing by the singulator, the envelope is successively fed past the moistener where its flap portion is moistened and is then passed through a sealer where the flap is sealed prior to the printing of, for example, postage values thereon by the printing device (postage meter). Moreover, the mail handling machine may further include a scale for weighing the mailpieces and a tape mechanism for printing of indicia on a tape.

Modern mail handling machines utilize digital printing techniques for producing images on a mailpiece being processed therethrough. Conventional digital printing techniques include bubble jet, piezoelectric ink jet, and thermal ink transfer which each produce an image in a dot matrix pattern. That is, in digital ink jet printing individual printhead elements (such as resistors or piezoelectric elements) are selectively electronically stimulated to expel drops of ink from a reservoir onto a substrate. In the case of thermal ink transfer, individual resistive elements which contact a thermal inking transfer tape are selectively energized to transfer ink from the tape on to a substrate in contact with the tape. In either case, by controlling the energizing timing of the individual printhead elements in conjunction with the relative movement between the printhead and the mailpiece, a dot matrix pattern is produced in the visual form of the desired indicia.

Digital printing technology has significant advantages when used in a mail handling apparatus as compared to older technology which utilized either a flat platen or a rotary drum to imprint indicia on mailpieces. For example, if the variable indicia image data needs to be changed, it can easily be done through the installation of new or upgraded software versus having to replace the entire meter since the flat platen and drum do no get removed. Moreover, greater printing speeds can be obtained as compared to conventional mechanical printing systems. However, the use of a digital printhead in a mail handling apparatus presents special maintenance requirements which must be undertaken in order to ensure that the printhead continues to perform satisfactorily. That is, since the size of the nozzle openings in the printhead through which the individual drops of ink are expelled are very small, they can easily become clogged by debris or dried ink. If this occurs, the clogged nozzle will not be able to have ink expelled therethrough. Eventually, if enough nozzles become clogged, the indicia image produced will degrade to an unacceptable level. Accordingly, it is very important to keep the printhead nozzles free of any contamination when the printhead is not printing.

Typically, office apparatus having digital printheads have a maintenance station located at one end of the direction of travel of the printhead. The maintenance station includes a printhead cover which is designed to cover and hermetically seal the printhead nozzles as the printhead moves into a maintenance (home) position. The hermetic seal helps to prevent the ink from drying in the nozzles and provides a shield from contamination while not printing. Moreover, the maintenance station typically has wipers associated therewith which wipe the nozzles just prior to or after their being covered by the printhead cover. The wipers remove any contamination that may have been deposited on the nozzles during printing or ink accumulated during maintenance. Additional maintenance features which may be associated with the maintenance station include the ability to provide a vacuum burst to the nozzles to unclog clogged nozzles and a purge capability for clearing the nozzles.

As previously mentioned, conventional office apparatus typically move their printheads back and forth along a single path of travel. The maintenance station is often located at the one end of the path of travel in the home position such that after a printing operation the printhead returns to the home position where it is serviced by the maintenance station. However, in a mail handling apparatus the front end feeder, singulator, moistener, sealer, printing station, and stacker are typically aligned one after the other in the direction of travel of the mailpiece through the mail handling apparatus. This creates a mail handling apparatus with a long footprint. Accordingly, if a maintenance station for a digital printhead is placed in line with the flow of mail, it will add to the overall length of the machine. Additionally, since the maintenance station is situated within the mail flow, it is very vulnerable to collecting paper dust associated with the mailpieces. Thus, the printhead cover could collect paper dust therein which, in turn, could clog the printhead nozzles when the printhead is protected by the cover.

SUMMARY OF THE INVENTION

It is an object of the invention to provide a mail handling apparatus having a digital printhead which is easily moveable between a print position in line with the flow of mail and a maintenance station that is not situated within the flow of mail, to minimize the footprint of the mail handling apparatus and position the maintenance station away from the flow of mailpieces through the mail handling apparatus. This object is met by a mail handling apparatus having a printing mechanism; means for moving the printing mechanism along a path of travel between a printing mechanism printing position and a printing mechanism maintenance position; a maintenance station positioned lateral to the path of travel; and means for rotating the printing mechanism along the path of travel to align the printing mechanism for engagement with the maintenance station as the printing mechanism moves into the maintenance position.

A further object of the invention is to provide a method for positioning a printing mechanism within a mail handling machine between a printing position and a maintenance station. The method including the steps of moving the printing mechanism along a path of travel between a printing mechanism printing position and a printing mechanism maintenance position; rotating the printing mechanism along the path of travel to align the printing mechanism for engaging the printing mechanism with a maintenance station as the printing mechanism moves into the maintenance position, the maintenance station being positioned lateral to the path of travel.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
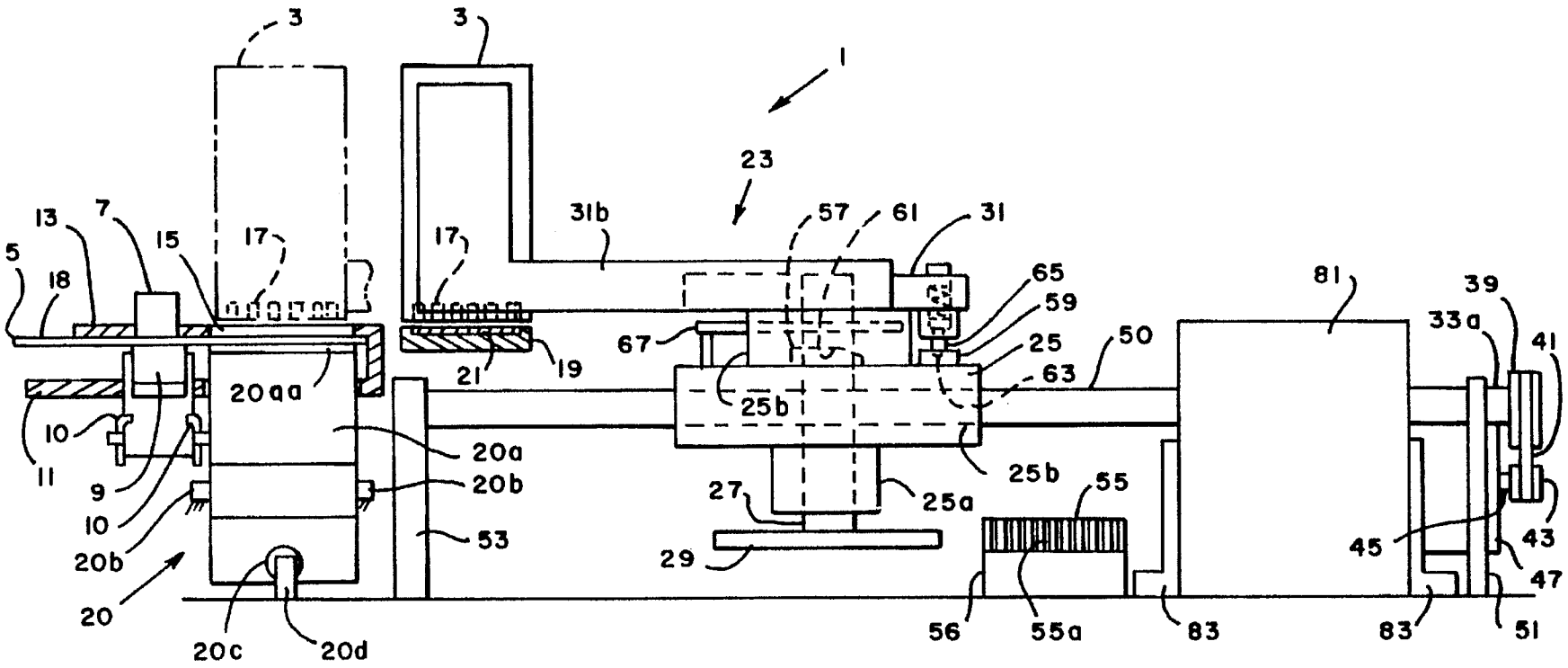
FIG. 1 is a front view of the inventive mail handling apparatus showing the printhead in the mailpiece printing position.
Figure 2:
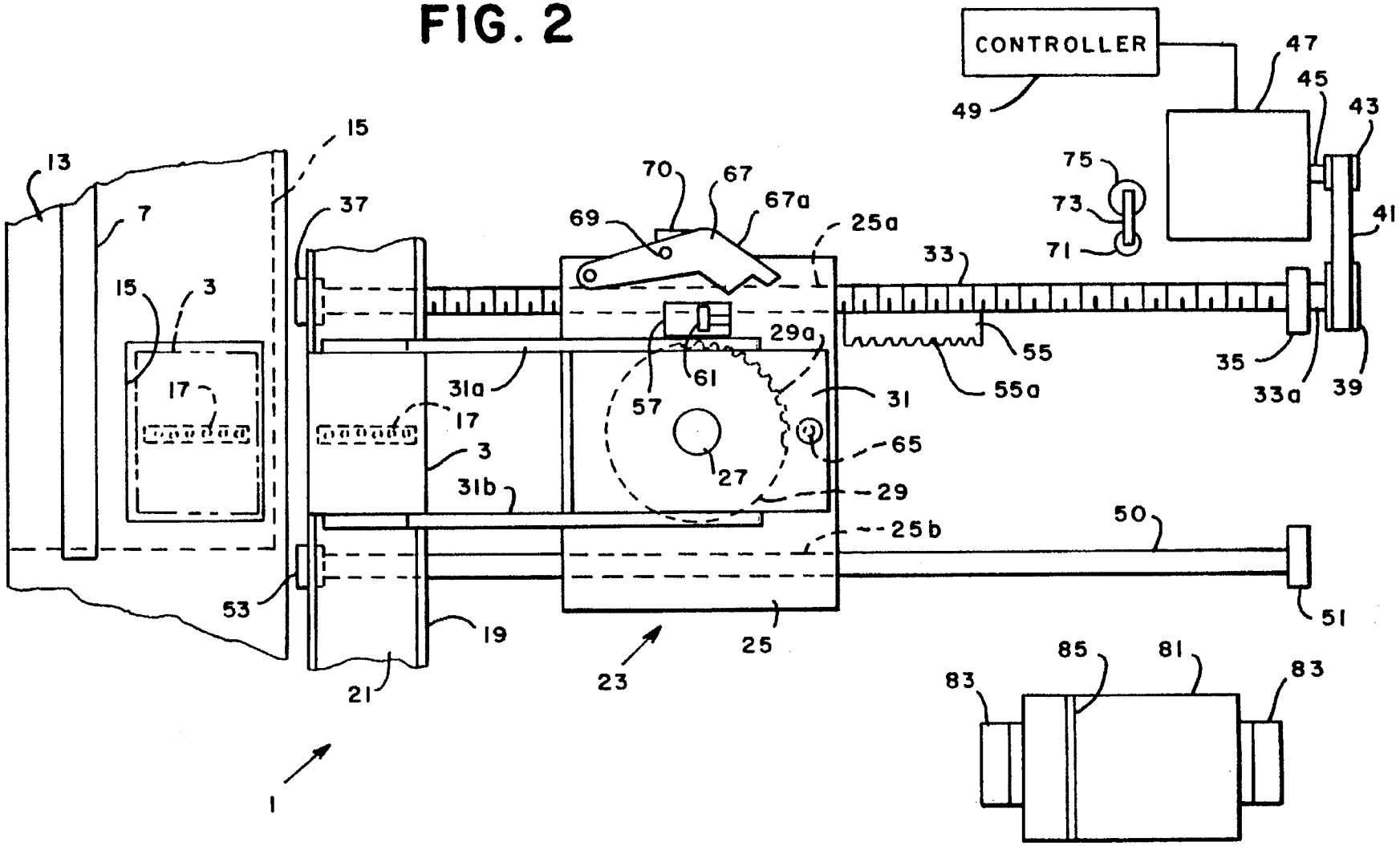
FIG. 2 is a top plan view of FIG. 1.
Figure 3:
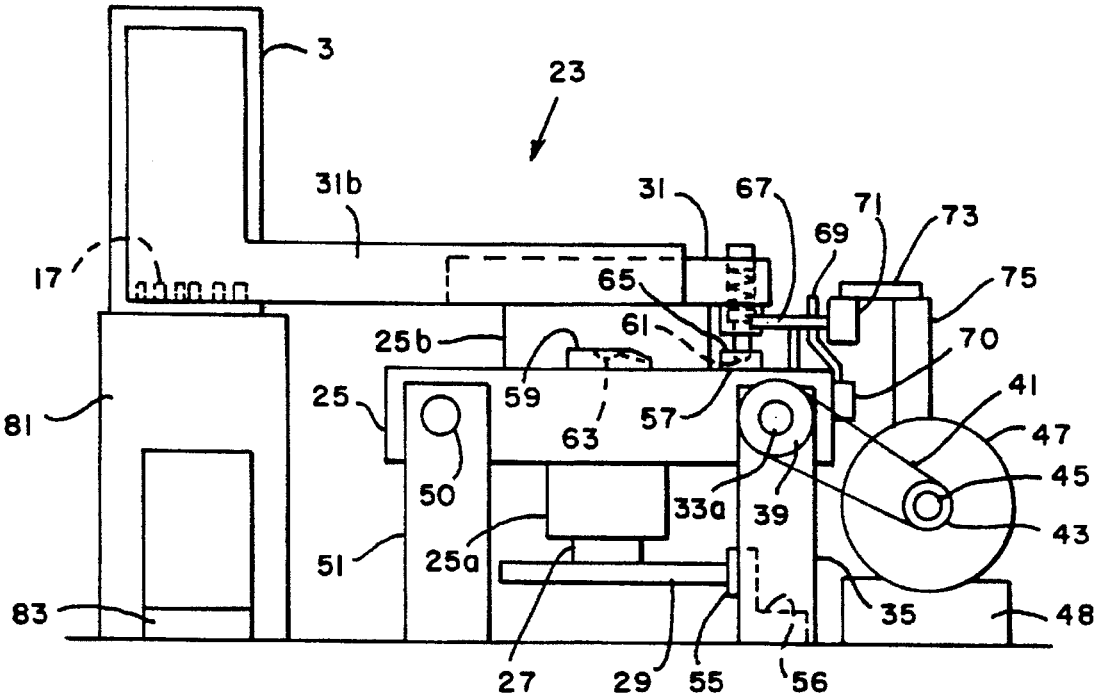
FIG. 3 is a right side view of FIG. 1.

Referring to FIGS. 1–5, the inventive printhead positioning apparatus is shown incorporated within a mail handling machine 1 (only portions of which are shown). In FIGS. 1 and 2, a printhead 3 is shown in solid lines in a tape printing position and in dashed lines in a mailpiece printing position. Specifically, FIG. 1 shows a front view of the mail handling apparatus 1 looking directly opposite to the flow of a mailpiece 5 through the mail handling apparatus 1. Mailpiece 5 is transported at a constant speed and in a conventional manner past the mailpiece printing position via the interaction of a driven belt 7 and an idler pulley 9 which is biased upwardly by springs 10. Pulley 9 is mounted to a plate structure 11 which in turn is mounted to a housing (not shown) of mail handling apparatus 1. A registration plate 13 of plate structure 11 includes an opening 15 therein through which ink from each of printhead nozzles 17 pass for deposit on mailpiece 5.

Figure 5:
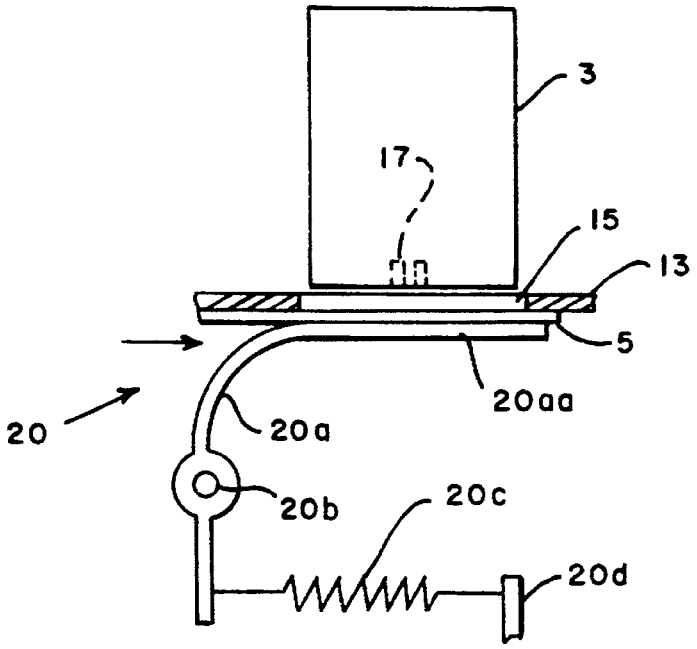
FIG. 5 is a left side view of FIG. 1 showing the top registration structure.

Referring to FIG. 5, a top registration structure is identified at 20. Structure 20 includes a curved plate **20*a* hingedly connected in a conventional manner at 20*b* and biased to rotate counterclockwise toward the bottom of registration plate 13 due to the biasing force of spring 20*c* which is connected between curved plate 20*a* and a stationary ground portion 20*d*. A top portion 20*aa* of plate 20*a* is wider than opening 15 so that it does not pass through opening 15. Thus, as mailpiece 5 enters the nip between top portion 20*aa* and the bottom of registration plate 13, plate 20*a* is forced to rotate in the clockwise direction of FIG. 5. Spring 20*a* however maintains a biasing force on plate 20*a* which keeps mailpiece 3 registered against the bottom surface of registration plate 13 thereby fixing the distance between the nozzles 17 and the top surface 18 of mailpiece 5. The fixed distance is necessary to ensure that an acceptable print quality is achieved. As the mailpiece 5 passes by printhead 3, nozzles 17 are energized in synchronism with the relative movement between printhead 3 and mailpiece 5 in a conventional manner to produce the desired image on the top surface 18 of mailpiece 5**.

A tape print station 19 is shown schematically. Tape print station 19 provides a piece of tape 21 below printhead 3 for printing thereon. The structure of tape print station 19 is well known in the art and no further description is considered necessary for the purpose of describing the invention claimed herein. Moreover, a registration structure to similar to that set forth above in connection with mailpiece 5 can be incorporated to ensure proper registration of tape 21 relative to nozzles 17.

Printhead 3 is attached to a printhead carriage assembly 23. Carriage assembly 23 includes a main platform 25 having a lower boss portion **25*a* and upper boss portion 25*b*. A shaft 27, having a gear segment 29 fixedly connected to one end thereof, is rotatably mounted within main platform 25, lower boss 25*a*, and upper boss 25*b*. A secondary platform 31 is fixedly connected to shaft 27 at the end opposite from gear segment 29. Thus, as shaft 27 rotates, gear segment 29 and secondary platform 31 will rotate therewith. Secondary platform 31 further includes a pair of L-shaped extending arms 31*a* and 31*b* which are attached to printhead 3 so that printhead 3 moves with secondary platform 31**.

Referring to FIG. 2, a lead screw 33 extends between first and second posts 35,37 and is rotatably mounted within each post 35,37. End portion **33*a* of lead screw 33 has a pulley 39 fixedly mounted thereto. Pulley 39 is operatively connected via timing belt 41 to pulley 43 which is fixedly mounted to and driven into rotation by shaft 45 of motor 47. Motor 47 is supported on base 48 and is electrically connected to a controller (i.e. microprocessor) 49 of the mail handling apparatus 1 so that when controller 49 energizes motor 47 in a conventional manner, the drive train of shaft 45, pulley 43, belt 41, and pulley 39 forces the lead screw 33 into rotation. Motor 47 is rotatable in two directions such that lead screw 33** can also be rotated in two directions.

Main platform 25 has a bore **25*a* extending therethrough which has screw threads corresponding to the threads on lead screw 33. Lead screw 33 passes through bore 25*a* in main platform 25 such that the threads of lead screw 33 and the threads of bore 25*a* intermesh. Thus, when lead screw 33 is forced into rotation by motor 47, main platform 25 is forced to move along lead screw 33 between the mailpiece printing position of FIG. 1 and the maintenance position of printhead 3 shown in FIGS. 3 and 4. Controller 49 is capable of deenergizing motor 47** as required in order to stop the printhead at any intermediate position between the mailpiece printing position and the maintenance position.

A guide rod 50 extends between and is fixedly mounted within third and forth posts 51,53. Guide rod 50 passes through a second bore **25*b* in main platform 25 such that main platform 25 is free to slide along guide rod 50 as it is forced to move between the mailpiece print position and the maintenance position. Guide rod 50 assists in stabilizing main platform 25 such that nozzles 17 are presented relative to the mailpiece 5 and the tape 21** at a predetermined orientation.

A rack gear 55 is mounted via supporting structure 56 to the mail handling apparatus housing at a position such that the teeth **29*a* of gear segment 29 intermesh with the teeth 55*a* of rack gear 55 during a portion of the movement of printhead 3 between the mailpiece printing position and the maintenance position. As rack gear teeth 55*a* intermesh with gear segment teeth 29*a*, shaft 27 is forced to rotate causing a corresponding rotation of secondary platform 31 and printhead 3** as will be discussed in more detail below.

Main platform 25 has a pair of projecting surfaces 57,59 each having a respective detent 61,63 therein. Secondary platform 31 has a spring loaded pin 65 extending therefrom which projects into one of the two detents 61,63 depending upon the position of the printhead 3, to secure the printhead 3 in position as discussed in more detail below. Additionally, main platform 25 has a lever arm 67 pivotally mounted thereto which is biased away from projecting surface 57 by a leaf spring 69 which projects through arm 67 and which is also mounted to a projecting portion 70 of main platform 25. Arm 67 remains in this position until during movement of main platform 25, it interferes with a projection 71 which is suspended from a rear column 75 of the mail handling apparatus 1. When carriage assembly 23 moves toward the maintenance position projection 71 initially contacts and rides along a front surface 67*a* of arm 67 ultimately forcing arm 67 into the position of FIG. 4 to help retain pin 65 in detent 61.

The operation if the inventive apparatus will be described in detail herein below. Assuming that printhead 3 is in the mailpiece printing position of FIG. 1 and printing has been completed, controller 49 energizes motor 47 to rotate shaft 45 in a direction that causes a corresponding rotation of lead screw 33 through the drive system of shaft 45, pulley 43, belt 41, and pulley 39. Lead screw 33 interacts with the threads in bore 25*a* forcing carriage assembly 23 to move toward the tape printing position of FIG. 1. Controller 49 can cause motor 47 to be deenergized at any position between the mailpiece printing position and the maintenance position of FIGS. 3 and 4, such as for example, at the tape printing station if printing on tape 21 is required. However, assuming that no tape printing is to occur, motor 47 will continue to operate to move carriage assembly 23 toward the maintenance position. Prior to reaching the maintenance position, gear segment teeth 29*a* intermesh with rack gear teeth 55*a*. As carriage assembly 23 continues to move toward the maintenance position, the interaction of gear segment teeth 29*a* and rack gear teeth 55*a* causes shaft 27 and, in turn, secondary platform 31 and printhead 3 to rotate (counterclockwise as viewed in FIG. 1) until the printhead 3 has rotated 90 degrees relative to its orientation in FIG. 1. At this point of rotation, gear segment 29 has moved to a position beyond rack gear 55 such that no further rotation of printhead 3 occurs and it is retained in its 90 degree detent position. Motor 47 remains energized until carriage 23 has moved to the maintenance position such that printhead 3 is aligned with a conventional maintenance station 81 mounted on a support structure 83 connected to the mail handling apparatus frame. As previously discussed, maintenance stations are well known in the art and can include a purge capability, a vacuum capability, a wiper for wiping contamination from the nozzles 17 and a cover which covers and seals the printhead nozzles 17 when the printhead 3 is in the maintenance position.

Figure 4:
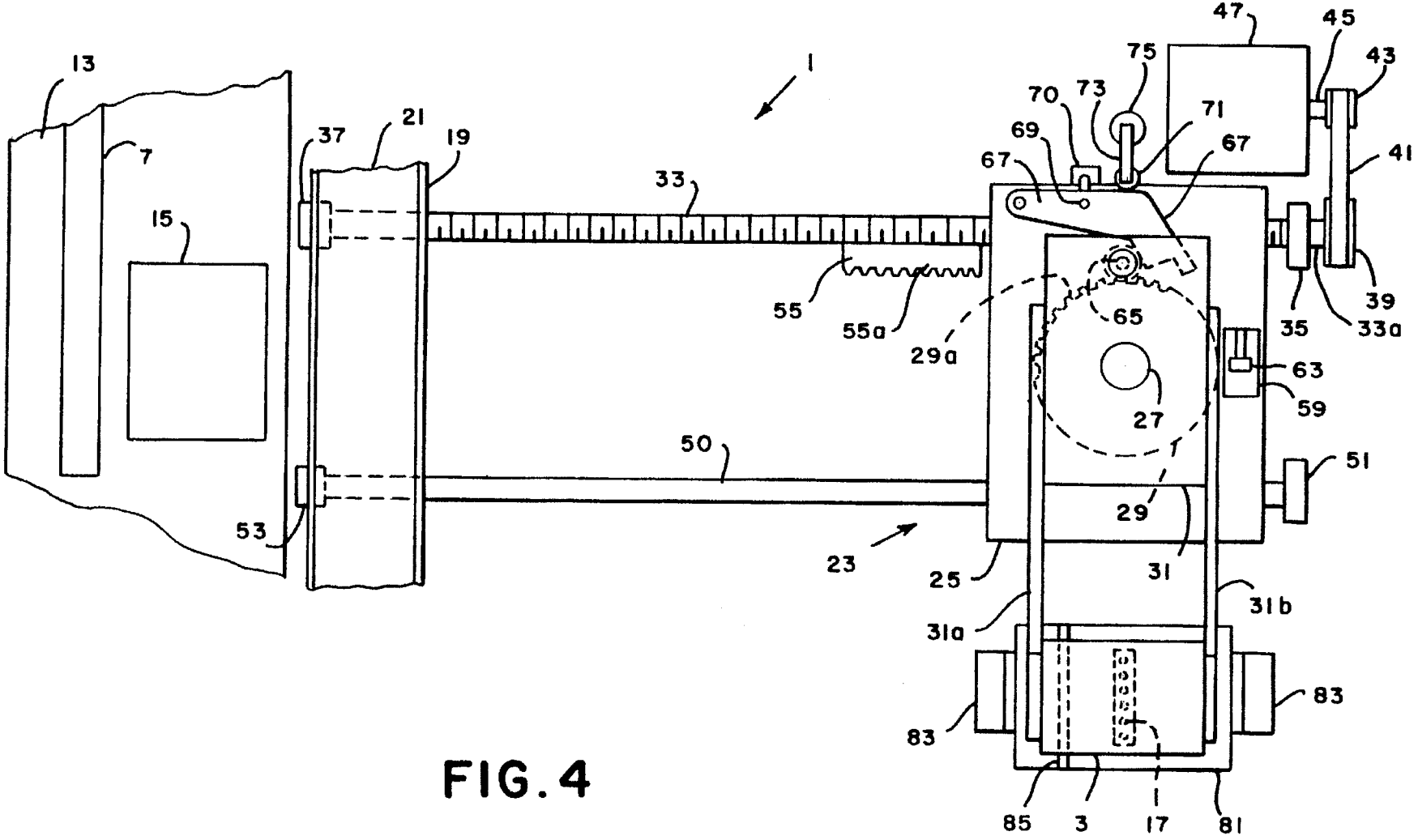
FIG. 4 is a top plan view of the mail handling apparatus showing the printhead in the maintenance position.

Referring to FIG. 4, it is important to note that since the nozzles 17 are located in a row transverse to the flow of mail, if a wiper associated with the maintenance station 81 were simply disposed in line with the movement of the printhead 3 back toward the maintenance station 81, the wiper would be wiping along the row of nozzles 17. This is an unacceptable way of wiping the nozzles 17 since if their is contamination on the first nozzle being wiped, the contamination could be spread into the remaining nozzles 17 as the nozzles 17 pass over the wiper. Accordingly, it is desirable that the wiper passes over the printhead nozzles 17 either transverse to the nozzle 17 row direction or at least an angle relative thereto. By positioning the maintenance station 81 lateral to the movement of carriage 23 and rotating the printhead 90 degrees prior to entering the maintenance station 81, the wiper blade 87 of the maintenance station 81 is positioned parallel to the row of nozzles 17 such that as the fully rotated printhead 3 is moved back into the maintenance station 81, wiper 85 passes across nozzles 17 transverse to the direction of the nozzle 17 row. While wiper 85 is shown as being part of the maintenance station 81, it could easily be positioned separate therefrom such that it would interact with the row of nozzles 17 during part of the actual 90 degree rotation of printhead 3.

A further feature of the invention, discussed briefly above, concerns projecting surfaces 57,59 and spring loaded pin 65. When printhead 3 is positioned as shown in FIG. 1, arm 67 is biased away from projection 57 and spring loaded pin 65 resides in detent 63 thereby holding printhead 3 in the orientation required for printing. As printhead 3 is rotated 90 degrees while moving toward the maintenance position, spring loaded pin 65 moves out of detent 63 and rotates in the counterclockwise direction with secondary platform 31. When platform 31 has rotated 90 degrees, pin 65 has now rotated into detent 61 to secure printhead 3 in the 90 degree position for subsequent engagement with the maintenance station 81. As the rotated printhead 3 continues to move toward the maintenance position, arm 67 contacts projection 71 and is forced to move against the biasing force of leaf spring 69 until it contacts spring loaded pin 65, further securing spring loaded pin 65 in detent 61. Arm 67 is needed to ensure that spring loaded pin 65 is not dislodged from detent 61 when wiper 85 contacts nozzles 17 and a cover (not shown) of maintenance station 81 is actuated in a known manner to cap and seal printhead 3.

It will be apparent to one possessing ordinary skill in the art that the movements of the printhead 3, carriage assembly 23, lever arm 67 and spring biased pin 65 are directly opposite to the movements set forth above as the carriage 23 moves from the maintenance position back to the printing position.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims.

What is claimed is:

1. A mail handling apparatus comprising:

a carriage assembly;

a digital printing mechanism having a plurality of printing nozzles and being rotatably connected to the carriage assembly;

means for moving the carriage assembly along a path of travel between a printing mechanism printing position and a printing mechanism maintenance position;

a maintenance station having a wiper blade and being positioned lateral to the path of travel; and means for rotating the printing mechanism out of the path of travel to align the printing nozzles of the printing mechanism substantially parallel to the wiper blade for engagement with the wiper blade as the carriage assembly moves into the maintenance position.

2. A mail handling apparatus as set forth in claim 1, wherein the mail handling apparatus includes a feed path along which mailpieces are processed through the mail handling apparatus, the feed path being transverse to the path of travel and the printing mechanism being located along the feed path in the printing position.

3. A mail handling apparatus comprising:

a printing mechanism;

means for moving the printing mechanism along a path of travel between a printing mechanism printing position and a printing mechanism maintenance position;

a maintenance station positioned lateral to the path of travel; and means for rotating the printing mechanism for engagement with the maintenance station as the printing mechanism moves into the maintenance position;

wherein the moving means comprises a moveable carriage assembly having the printing mechanism operatively connected to the carriage assembly to move therewith, a motor and a lead screw, and wherein the lead screw is connected to the motor and is driven into rotation by the motor and the carriage assembly is mounted on the lead screw such that at times when the motor drives the lead screw into rotation a corresponding movement of the carriage assembly along the lead screw occurs.

4. A mail handling apparatus as set forth in claim 3, wherein the rotating means comprises a shaft rotatably disposed in the carriage assembly and fixedly connected to the printing mechanism, a first gear fixedly connected to the shaft to rotate therewith, and a second gear located to intermesh with the first gear during at least a portion of movement of the carriage assembly along the lead screw, and wherein at times when the first and second gears intermesh the shaft is forced into rotation causing a corresponding rotation of the printing mechanism.

5. A mail handling apparatus as set forth in claim 4, wherein the carriage assembly comprises a main platform and a secondary platform, and wherein the main platform is mounted on the lead screw, the printing mechanism is fixedly mounted on the secondary platform, and the secondary platform is mounted on the shaft to rotate therewith.

6. A mail handling apparatus as set forth in claim 5, wherein the secondary platform has a spring loaded pin mounted thereon and the main platform has first and second detents, at times when the printing mechanism is in the printing position the spring loaded pin is disposed in the first detent securing the printing mechanism, at times when the printing mechanism is in the maintenance position the spring loaded pin is in the second detent, and at times when the printing mechanism moves along the path of travel such that the first and second gears intermesh the secondary platform rotates with the shaft causing a corresponding movement of the spring loaded pin between the first and second detents.

7. A mail handling apparatus as recited in claim 6, further comprising a lever arm pivotally mounted to the secondary platform, means for biasing the lever arm away from the secondary platform, and means for moving the lever arm against the biasing force of the biasing means and into contact with the spring biased pin during movement of the carriage assembly along the lead screw such that the lever secures the spring biased pin within the second detent prior to engagement of the printing mechanism with the maintenance station.

8. A method for positioning in a mail handling apparatus a carriage assembly having rotatably mounted thereon a digital printing mechanism with a plurality of nozzles, the method comprising the steps of:

moving the carriage assembly along a path of travel between a printing mechanism printing position and a printing mechanism maintenance position;

rotating the printing mechanism out of the path of travel to align the printing mechanism substantially parallel to a wiper blade of a maintenance station for engaging the nozzles with the wiper blade as the printing mechanism moves into the maintenance position, the maintenance station being positioned lateral to the path of travel.

9. A method as set forth in claim 8, wherein the path of travel is transverse to a feed path of the mail handling apparatus over which mailpieces are processed and the printing mechanism is located in the feed path in the printing position.

* * * * *